United States Patent [19]

Krogsrud

[11] 4,245,133

[45] Jan. 13, 1981

[54] ROOF FOR COVERED ELECTRIC SMELTING FURNACES

[75] Inventor: Harald Krogsrud, Gjettum, Norway

[73] Assignee: Elkem-Spigerverket, A/S, Oslo, Norway

[21] Appl. No.: 20,427

[22] Filed: Mar. 14, 1979

Related U.S. Application Data

[63] Continuation-in-part of Ser. No. 966,270, Dec. 4, 1978, abandoned.

[30] Foreign Application Priority Data

Dec. 6, 1977 [NO] Norway ..... 774162

[51] Int. Cl.[3] ..... F27D 1/12

[52] U.S. Cl. ..... 13/35

[58] Field of Search ..... 13/32, 35

[56] References Cited

U.S. PATENT DOCUMENTS 4,021,603 5/1977 Nanjyo et al. ..... 13/35

*Primary Examiner*—Roy N. Envall, Jr.

*Attorney, Agent, or Firm*—Eyre, Mann, Lucas & Just

[57] ABSTRACT

An improved roof for covered electric smelting furnaces is disclosed. Cooling pipes are disposed on the outside of the roof and are of sufficient capacity and spacing to maintain a temperature on the inside of the roof of 150° C.–400° C. A sealing arrangement for adjacent sectors of the roof is also disclosed.

10 Claims, 2 Drawing Figures

ROOF FOR COVERED ELECTRIC SMELTING FURNACES

This application is a continuation in part of United States Application Ser. No. 966,270 filed Dec. 4, 1978 now abandoned.

The present invention relates to electric smelting furnaces and, more particularly, to improvements in the roofs for electric smelting furnaces.

Electric smelting furnaces have been known and used for a great number of years. Covered electric smelting furnaces have also been known and used for a great number of years. However, known covered smelting furnaces generally have not been made gas tight. Because of environmental awareness and government regulations, the desirability of making gas tight covered smelting furnaces has become more and more pronounced. However, there are also problems associated with such covers for electric smelting furnaces.

As is well known in the art, the new generation of covers for electric smelting furnaces typically comprise a horizontal or approximately horizontal roof section and a side wall which is vertical or substantially vertical and is generally annular. The overall appearance of the roof is similar to the appearance of a fez or the cover of a cake plate. However, because of the massiveness of the cover for an electric smelting furnace, it is composed of a plurality of pie-shaped sections which are joined together.

The abutting sections of the furnace cover are normally bolted together and are usually provided with some type of insulating material between the joining flanges in order to reduce the escape of gas from the smelting furnaces. This insulating material is typically asbestos, mineral wool, or the like. However, because of various factors, including irregularity of the joining flanges of the plates and porosity of the insulating materials, it is guite difficult to maintain a completely gas tight seal between adjacent plates.

With covered smelting furnaces there is, of course, a considerable buildup of heat. This has associated with it a number of known undesirable drawbacks, and it is therefore desirable to cool the furnace cover.

There are, of course, well known ways of cooling metal plates, the most typical of which is to have a plurality of bores through the plates through which water can circulate. However, cooling arrangements of this type have two substantial disadvantages. In the first place, the cooling medium, e.g., water, usually travels a relatively long path during which it experiences a considerable rise in temperature. This results in different temperatures throughout the roof of the furnace, which has a number of disadvantages including unequal thermal expansion, possible condensation of sulfur, and the like. A second disadvantage to such known systems is that even a pin hole in the plate in the area of the cooling bore can result in the introduction of water to the smelting process, with a resulting and very undesirable reaction with the gases of the smelting furnace operation.

The applicant has now discovered an arrangement for cooling smelting furnace roofs which eliminates the foregoing disadvantages. More particularly, a plurality of cooling pipes are affixed to the outside of the furnace cover with a continuous weld. The pipes are of a capacity and spacing sufficient to maintain the temperature on the inside of the cover of the furnace in the range of about 150° C.–400° C. The applicant has also discovered a sealing arrangement which can be used between adjacent plates to help achieve the desired cooling by being completely gas tight.

These and other aspects of the present invention will be more fully understood with respect to the accompanying drawings, wherein.

Figure 1:
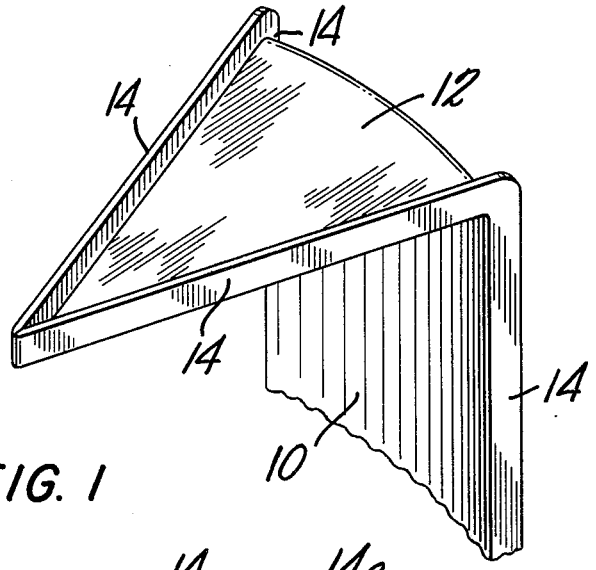
FIG. 1 shows one of the pie-shaped plates making up a cover as used in the present invention.

Referring first to FIG. 1, which is a general showing of a pie-shaped segment of a cover for an electric smelting furnace, it comprises an arcuate section 10 and a horizontal section 12. When a plurality of these pie-shaped elements are joined together by bolts through the flanges 14, a structure is obtained resembling a fez or the cover to a cake plate. For the sake of clarity, the drawing of FIG. 1 shows only the general construction of the cover plate and does not show the detailed construction of the present invention.

Figure 2:
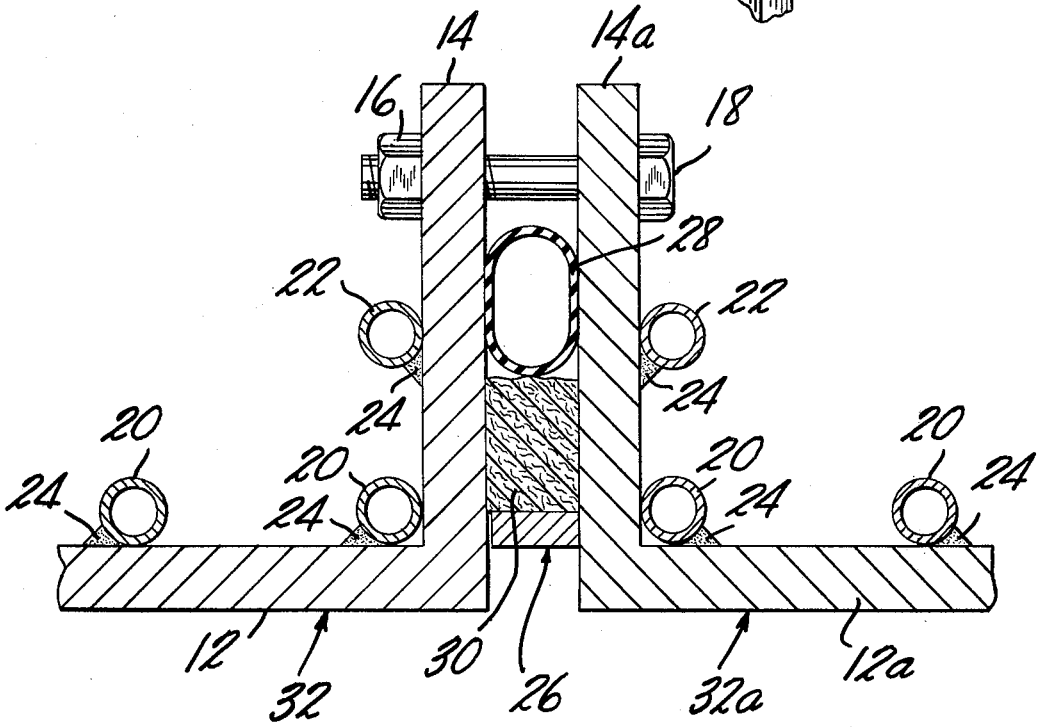
FIG. 2 shows in considerably larger scale a cross-sectional view of a pair of pie-shaped plates at the abuttment thereof.

Referring now to FIG. 2, there is shown the connection of two of the plates of FIG. 1. As there shown, the two top plates 12 and 12*a* having flanges 14 and 14*a* are joined together by the cooperating nut and bolt arrangement 16, 18 respectively. On the plates 12, 12*a* are welded tubes 20 for carrying a cooling medium. Also shown are tubes 22 for carrying a cooling medium. The purpose of these tubes 22 will be discussed hereinafter. Each of the tubes 20 is joined to plate 12 or 12*a* by a continuous weld 24, and a continuous weld 24 is also preferably used in connection with tubes 22.

Between the flanges 14, 14*a* is positioned a spacer member 26. Between the two flanges 14, 14*a* there is also positioned a hydraulic tube 28, the hydraulic tube having a pressure established therein. Because the Hydraulic tube is gas impermeable and is also capable of adapting to irregularities on the surface of the flanges 14, 14*a*, it insures a substantially complete gas tight seal. Insulating material 30 such as mineral wool or the like is positioned between the spacer 26 and the hydraulic tube 28 in order to help protect the hydraulic tube from the heat of the smelting furnace. Cooling tubes 22 also help to cool the flanges 14, 14*a* so that they do not become so hot as to melt the hydraulic tube 28. The hydraulic tube suitably has an internal pressure on the order of 0.5–5 atmospheres.

With respect to the cooling tubes 20, these are of sufficient capacity and appropriately spaced so that when the cooling medium is passed through the bores thereof, the temperature on the surfaces 32 and 32*a* of the plates 12 and 12*a* stays within a temperature range of about 150° C.–400° C. The exact dimensions for the cooling tubes and the spacing between adjacent tubes will, of course, vary depending upon the size and design of the smelting furnace and the nature of the particular smelting process employed. However, in a typical installation where the plates 12, 12*a* are about 15–30 mm in thickness, the tubes 20 can suitably have a wall thickness of about 4–6 mm and an interior diameter of about 10–15 mm. The spacing of the pipes with this typical arrangement is suitably about 60–110 mm on center.

In the system of the present invention, it is also preferably desirable to maintain relatively even heat throughout the roof plates 12, 12*a*, and it is desirable to have a temperature variation of no more than about 25° C. It has been found that this result can be maintained by making the cooling pipes relatively short so that there is no more than about a 25° C. rise in temperature of the cooling medium from its introduction to a cooling pipe until it leaves the cooling pipe. It has been found that with the constructional dimensions as described hereinbefore, a pipe length of about 15–25 meters will result in a temperature rise of only about 10° C.–15° C. where water is the cooling medium. The plurality of cooling pipes can suitably be supplied with a manifold (not shown) in known manner.

It will be understood that the claims are intended to cover all changes and modifications of the preferred embodiments of the invention, herein chosen for the purpose of illustration, which do not constitute departures from the spirit and scope of the invention.

What is claimed is:

1. In a roof for covered electric smelting furnaces wherein the roof comprises a plurality of abutting pie-shaped sections of steel plate, cooling pipes welded to the outside surface of the steel plates of the roof with continuous welds, the cooling pipes being of sufficient capacity and effective spacing to be capable of maintaining a temperature on the inside of the roof between 150° C. and 400° C. when said smelting furnace is in operation, and a cooling medium which flows through said cooling pipes, the length of the cooling pipes being such that there will be a rise in temperature of the cooling medium of no more than about 25° C. from the introduction of the cooling medium to the cooling pipe until the cooling medium leaves the cooling pipe.

2. The roof of claim 1 wherein the cooling pipes are welded to the outside surface of the steel plates with continuous welds.

3. The roof of claim 1 wherein the length of the cooling pipes is such that there will be a rise in temperature of the cooling medium of no more than about 25° C. from the introduction of the cooling medium to the cooling pipe until the cooling medium leaves the cooling pipe.

4. The roof of claim 1 wherein the plates are from about 15–30 mm in thickness, the cooling tubes have a wall thickness between about 4 and 6 mm, and an interior diameter of about 10–15 mm, and wherein the spacing of the pipes is from about 60 mm to about 110 mm on center.

5. The roof of claim 4 wherein the length of the cooling pipes is between about 15 and 25 meters.

6. The roof of claim 1 wherein the abutting pie-shaped sections have parallel facing flanges at their point of abuttment by means of which they are joined together.

7. In a roof for covered electric smelting furnaces wherein the roof comprises a plurality of abutting pie-shaped sections of steel plate, cooling pipes welded to the outside surface of the steel plates of the roof, the cooling pipes being of sufficient capacity and effective spacing to be capable of maintaining a temperature on the outside of the roof between about 150° C. and 400° C. when said smelting surface is in operation and wherein the abutting pie-shaped sections have parallel facing flanges at their point of abuttment by means of which they are joined together and wherein there is a spacer between the two flanges, positioned above which is a hydraulic tube effective to create a substantially complete gas tight seal.

8. The roof of claim 7 wherein an insulating material is disposed between the spacer and the hydraulic tube.

9. The roof of claim 7 wherein the insulating material is mineral wool.

10. The roof of claim 7 wherein cooling tubes are disposed on the outside surface of the flanges substantially opposite the hydraulic tube.

* * * * *